US009044801B2

(12) United States Patent
Golovashchenko et al.

(10) Patent No.: US 9,044,801 B2
(45) Date of Patent: Jun. 2, 2015

(54) DEEP DRAW MANUFACTURING PROCESS

(71) Applicant: Ford Global Technologies, LLC, Dearborn, MI (US)

(72) Inventors: Sergey Fedorovich Golovashchenko, Beverly Hills, MI (US); John Joseph Francis Bonnen, Milford, MI (US); Scott Alwyn Dawson, Rochester, MI (US); Rodrigue Narainen, Rochester Hills, MI (US); Alexander Mamutov, Dearborn, MI (US); Andrew DiVeto, Plymouth, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 14/058,624

(22) Filed: Oct. 21, 2013

(65) Prior Publication Data

US 2015/0107321 A1 Apr. 23, 2015

(51) Int. Cl.

| | |
|---|---|
| ***B21D 24/04*** | (2006.01) |
| ***B21D 22/06*** | (2006.01) |
| ***B21D 24/00*** | (2006.01) |
| ***B21D 26/021*** | (2011.01) |

(52) U.S. Cl.

CPC ..... *B21D 22/06* (2013.01); *B21D 24/005* (2013.01); *B21D 26/021* (2013.01)

(58) Field of Classification Search

CPC ..... B21D 22/06; B21D 24/005; B21D 26/021
USPC ..... 72/57, 60, 342.3, 348, 349, 350
See application file for complete search history.

(56) References Cited

U.S. PATENT DOCUMENTS

| | | | | |
|---|---|---|---|---|
| 4,356,717 | A * | 11/1982 | Okunishi et al. | 72/342.3 |
| 5,600,991 | A * | 2/1997 | Munzen | 72/348 |
| 6,227,023 | B1 | 5/2001 | Daehn et al. | |
| 7,516,634 | B1 | 4/2009 | Golovashchenko et al. | |
| 8,250,896 | B2 * | 8/2012 | Hirotani | 72/350 |
| 8,261,591 | B2 * | 9/2012 | Hielscher | 72/350 |
| 2008/0098789 | A1 * | 5/2008 | Hori et al. | 72/349 |
| 2008/0134741 | A1 | 6/2008 | Golovashchenko et al. | |
| 2009/0272165 | A1 | 11/2009 | Golovashchenko et al. | |
| 2009/0272167 | A1 | 11/2009 | Golovashchenko | |
| 2009/0272168 | A1 | 11/2009 | Golovashchenko et al. | |
| 2010/0175447 | A1 | 7/2010 | Golovashchenko | |
| 2011/0088442 | A1 | 4/2011 | Golovashchenko | |
| 2012/0180542 | A1 * | 7/2012 | Golovashchenko | 72/57 |

FOREIGN PATENT DOCUMENTS

| | | |
|---|---|---|
| CA | 2584051 | 5/2006 |
| WO | 02070163 | 9/2002 |

* cited by examiner

*Primary Examiner* — David B Jones
(74) *Attorney, Agent, or Firm* — Damian Porcari; Brooks Kushman P.C.

(57) ABSTRACT

A method of manufacturing a drawn panel and a die set. The method includes clamping a blank between a binder and a die that defines a cavity. A first draw punch contacts the blank in advance of a second punch that subsequently engages the blank. A central area of the blank is drawn by the first draw punch that clamps a central area of the blank against a lower die. Side areas of the blank are drawn into the cavity by the side punches while the central punch clamps the blank again the lower die.

12 Claims, 5 Drawing Sheets

DEEP DRAW MANUFACTURING PROCESS

STATEMENT REGARDING FEDERALLY SPONSORED RESEARCH OR DEVELOPMENT

The invention was made with Government support under Contract No. DE-FG36-08G018128. The Government has certain rights to the invention.

TECHNICAL FIELD

This application relates to processes for drawing and forming sheet metal parts.

BACKGROUND

Deep drawn panels are usually stamped out of extra deep draw quality steel that has excellent formability. Parts made of extra deep draw quality steel are substantially heavier than parts made of aluminum alloys or advanced high strength steel that have equivalent strength. The need to reduce the weight of vehicles to improve fuel economy necessitates development of new techniques for forming parts from lighter and stronger aluminum alloys or advanced high strength steel.

Drawing aluminum alloys or advanced high strength steel panels to form a central deep cavity with sharp corners is very problematic because the material from a flange area of the blank cannot easily be drawn into the central cavity due, in part, to the contour of the features on the sides of the panel. A typical example of such a panel would be a dash panel for a vehicle, a passenger compartment floor pan, or the like. One approach to providing a large panel having deep cavities out of aluminum alloys or advanced high strength steel is to subdivide the part and form the part in multiple pieces. However, this multi-part approach adds processing steps such as assembly and welding steps and may result in less accurate part shapes with added potential for tolerance stack-ups.

Drawing wide parts with deep draw areas in extra deep draw quality steel may be accomplished without causing the material to split. However, attempts to form the same part with lighter weight materials having higher strength/lower formability using existing stamping technologies on conventional presses resulted in excessive splits. In particular, forming a dash panel using less ductile blanks of BH280, DP500, HSLA350 or aluminum alloy AA5182 produced large splits.

There is a need for forming technology for drawing large panels having deep cavities out of aluminum alloys or advanced high strength steel to achieve potential weight savings. This disclosure is directed to achieving this objective and other objectives as summarized below.

SUMMARY

According to one aspect of this disclosure, a method is disclosed for deep drawing a wide panel formed of aluminum or high strength steel without splitting. The method comprises first clamping a blank in a binder of a draw die set. A first area of the blank is drawn by a first draw punch. The first area of the blank is clamped by the first punch. A second area of the blank is drawn by a second draw punch while the first draw punch clamps the central area.

According to other aspects of the method, the binder of the draw die set may include a plurality of draw beads formed on the binder ring and the lower die may define a plurality draw bead grooves that each receive one of the draw beads. Two draw beads and two draw bead grooves may be provided in selected areas of the binder ring and lower die to provide increased resistance in the selected areas during the step of drawing the first area of the blank with the first draw punch. The selected area of the binder ring and lower die may further comprise a plurality of areas near the corners of the binder ring and lower die.

The method may further comprise forming a pocket in the first area that is drawn from the first area towards the second area during the step of drawing the second area of the blank.

The method may further comprise hydro-forming a predetermined area of the blank.

The method may further comprise hydro-forming a pocket in the first area of the blank to have a desired shape.

According to another aspect of this disclosure, a method of manufacturing a drawn panel comprises clamping a blank in a binder of a draw die set that includes a plurality of draw punches and a die that defines a cavity. A central area of the blank is drawn with a center draw punch into the cavity. The central area is clamped by the center draw punch against the die and at least one side area of the blank is drawn into the cavity by a side draw punch while the center draw punch clamps the central area of the blank.

According to another aspect of the method, the binder of the draw die set may include a plurality of draw beads formed on the binder ring. A plurality draw bead grooves may be provided on the lower die that each receives one of the draw beads. Two draw beads and two draw bead grooves may be provided in a selected area of the binder ring to provide increased resistance in the selected areas during the step of drawing the first area of the blank with the first portion of the draw punch. The selected area of the binder ring may further comprise a plurality of areas in the corners of the binder ring.

The method may further comprise forming a pocket in the central area that is drawn from the central area towards the side area during the step of drawing the side area of the blank.

The method may further comprise hydro-forming a predetermined area of the blank after the blank is drawn. Further, the method may comprise hydro-forming the pockets in the first area of the blank to have a desired shape.

Another aspect of this disclosure relates to a draw die set for drawing a blank that includes a die, a binder ring and a plurality of punches. The lower die defines a die cavity within a peripheral clamping surface. The binder ring clamps the blank against the clamping surface. The punches are disposed within the binder ring and have an advance contact punch and at least one delayed contact punch. The advance contact punch engages the blank and draws a first area of the blank into the die cavity and then clamps the first area against the lower die while the delayed contact punch engages the blank to draw a second area of the blank.

According to another aspect of this disclosure, the clamping surface may define a plurality of grooves. The binder ring may include a plurality of draw beads that are received in the plurality of grooves. Two rows of grooves and two draw beads may be provided where corners are to be formed in the blank.

The above aspects and other aspects of this disclosure will be more fully described below with reference to the attached drawings.

DETAILED DESCRIPTION

A detailed description of the illustrated embodiments of the present invention is provided below. The disclosed embodiments are examples of the invention that may be embodied in various and alternative forms. The figures are not necessarily to scale. Some features may be exaggerated or minimized to show details of particular components. The specific structural and functional details disclosed in this application are not to be interpreted as limiting, but merely as a representative basis for teaching one skilled in the art how to practice the invention.

Figure 1:
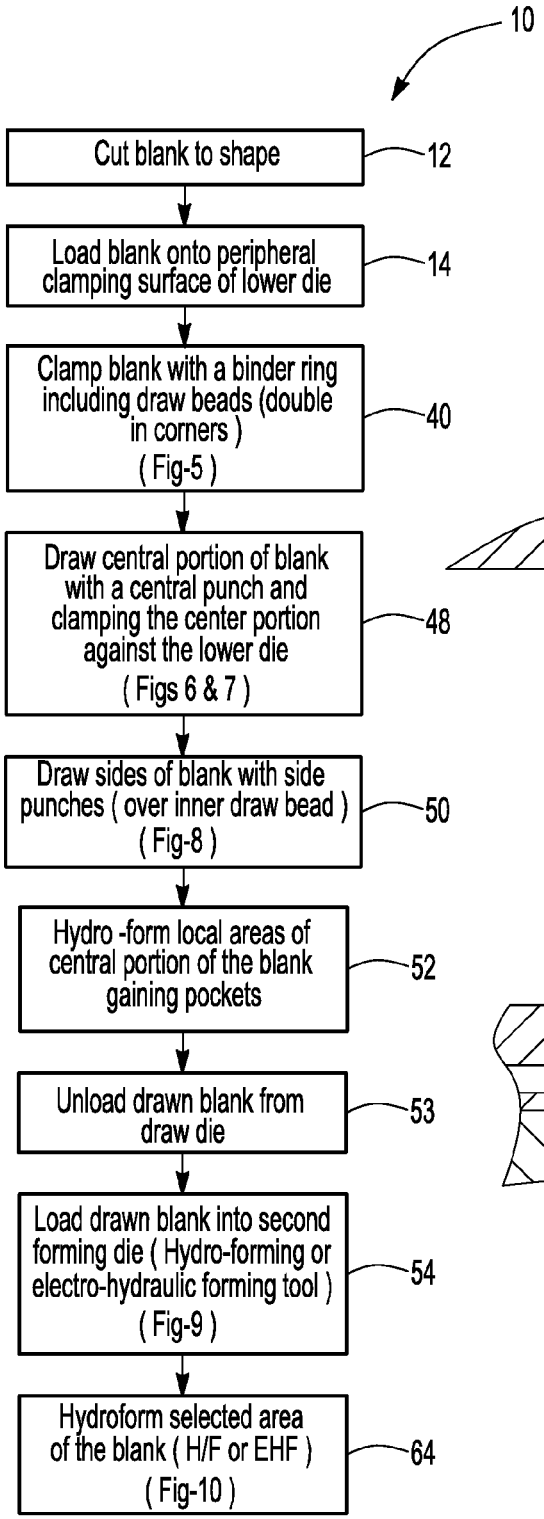
FIG. 1 is a flowchart of a method of drawing a panel according to one embodiment of this disclosure.

Referring to FIG. 1, a method of drawing a panel is illustrated with reference to a flowchart that is generally indicated by reference numeral 10. In the method 10, a blank 11 (shown in FIGS. 2 and 4-8) is cut to shape at 12. The blank 11 is then loaded onto a peripheral clamping surface that is engaged by a binder ring of a draw die at 14. The draw die is operated by a conventional draw press (not shown).

Figure 2:
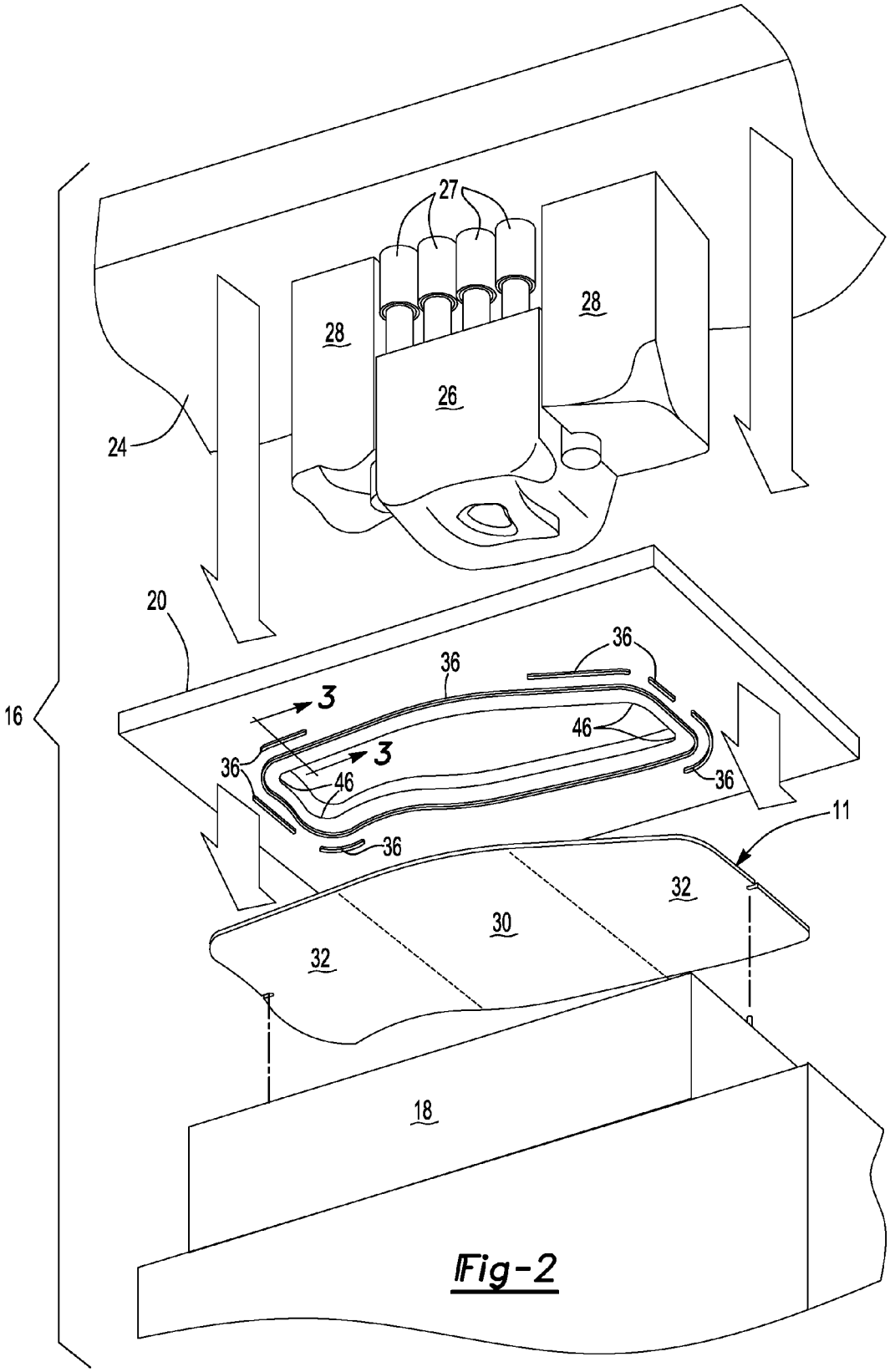
FIG. 2 is an exploded perspective view of one embodiment of a die set that may be used in conjunction with the method described with reference to FIG. 1.

Referring to FIG. 2, a draw die set 16 is shown to include a lower die 18 and a binder 20 are shown with the blank 11, or panel, disposed between the binder 20 and a peripheral clamping surface 21 of the lower die 18. While in most instances the lower die 18 is disposed below the binder, this orientation may be reversed or changed depending upon the orientation and structure of the draw press.

An upper plate of the draw press is generally indicated by reference numeral 24. The upper plate 24 supports a central punch 26 that is backed by cylinders 27 to retract and advance the central punch 26 relative to the upper plate 24. The central punch 26 engages the blank 11 and holds the blank against the lower die 18. The cylinders 27 may be hydraulic, pneumatic or nitrogen cylinders that advance and retract the central punch 26 coordinating the advancement of the central punch 26 and the side punches 28 in a way that the sheet metal blank flows from the flange and spreads along the surface of the lower die without wrinkles and splits. As an alternative, the central punch 26 could be biased by a set of die springs or other biasing mechanism that engages the blank 11 and holds the blank 11 against the lower die.

In the illustrated embodiment, two side punches 28 are provided on opposite sides of the central punch 26 and are supported by the upper plate 24. The central punch 26 acts on a central area 30 of the blank 11 to initially draw the central area 30 deeply into the lower die 18. The side punches 28 subsequently engage side areas 32 of the blank 11 to draw the side areas into a desired shape. The side punches 28 and central punch 26 are moved in tandem by the draw press (not shown) to provide an advance contact portion (e.g., the central punch 26) and a delayed contact portion (e.g., the side punches 28).

Figure 3:
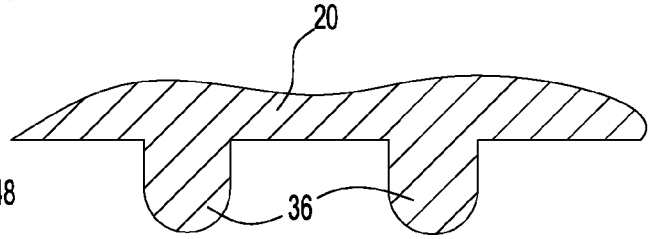
FIG. 3 is a fragmentary cross-sectional view of a binder ring including two draw beads.
Figure 4:
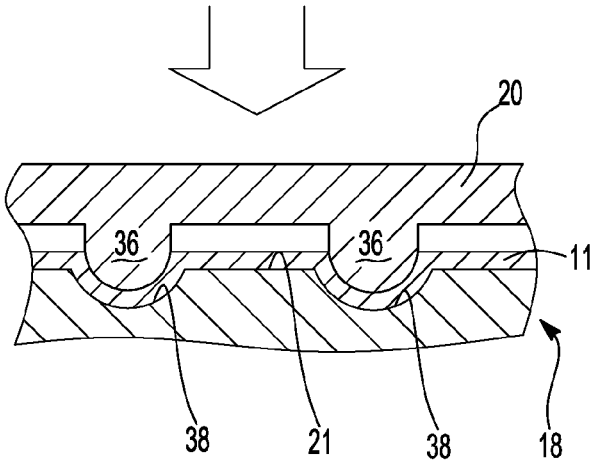
FIG. 4 is a fragmentary cross-sectional view of a sheet metal panel retained between draw beads on a binder ring and draw bead grooves provided on a die.

Referring to FIGS. 2 through 4, a plurality of draw beads 36 are provided on the binder 20 that extend from the lower side of the binder 20. The binder 20 with the draw beads 36 restrains a peripheral flange of the blank 11 in the draw bead grooves 38 formed in the peripheral clamping surface 21 of the lower die 18. At 40 in FIG. 1, the draw beads 36 and draw bead grooves 38 restrain the blank 11 from being drawn too readily into the lower die 18. The draw beads 36 and draw bead grooves 38 provide a controlled level of resistance to the drawing operation allowing the blank 11 to be drawn without creating splits or wrinkles in the blank 11. Referring specifically to FIG. 2, several corner areas 44 are shown in conjunction with double draw beads 36 that provide increased resistance to the drawing operation in its initial stages when the central punch 26 initially draws the blank 11 into the cavity 42.

In FIG. 4, two draw beads 36 are provided in conjunction with two draw bead grooves 38. This configuration may be used in selected areas of the draw die set 16, particularly in the corner areas 44 of the draw die set 16. The double draw beads 36 and draw bead grooves 38 provide increased resistance in the corners for a first step of the drawing operation at 48 in FIG. 1 that will be described in greater detail below with reference to FIGS. 6 and 7. The amount of resistance to the drawing operation during the second drawing step at 50 in FIG. 1 and as illustrated in FIGS. 7 and 8 is reduced, and the blank 11 is permitted to be drawn more readily into the lower die 18 when the peripheral edge of the blank 11 is drawn inboard of the outermost draw bead 36.

Figure 5:
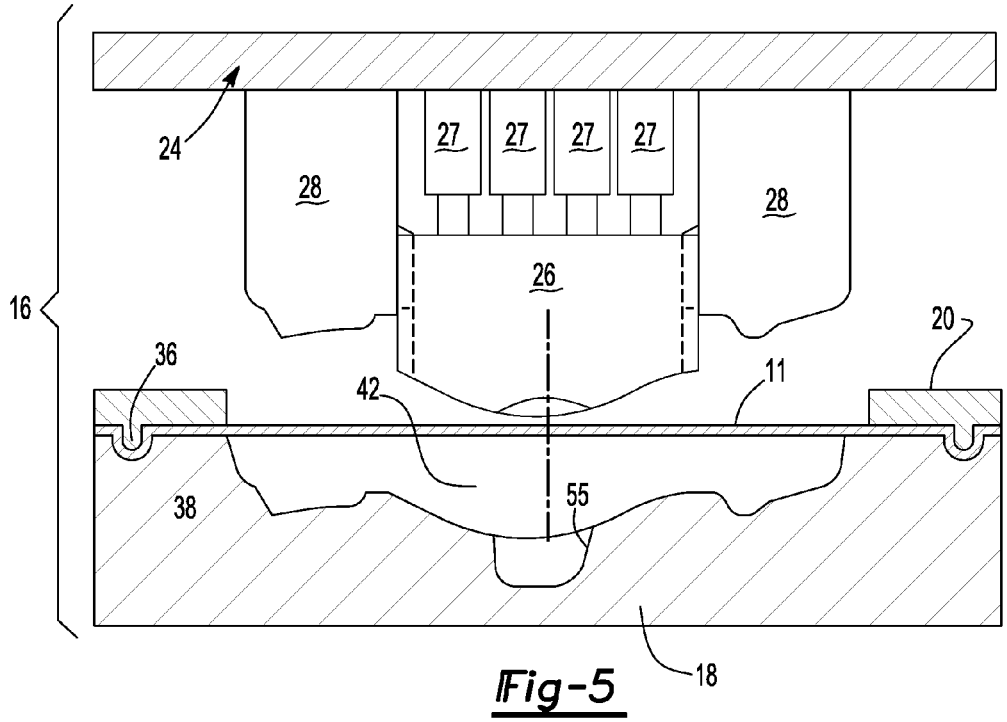
FIGS. 5-8 are diagrammatic cross-sectional views of one embodiment of a draw die set illustrating four phases in the deep draw forming process described in FIG. 1.

Referring to FIGS. 1 and 5, the blank 11 is clamped by the binder ring with the draw beads 36 and draw bead grooves 38 controlling the flow of the blank 11 into the lower die 18 at 40 in FIG. 1. Referring specifically to FIG. 5, the draw die set 16 is shown with the blank 11 clamped by the binder 20 against the lower die 18. The central punch 26 supported by the upper plate 24 is shown in an extended position and just prior to engagement with the blank 11. A draw bead 36 is shown with the blank 11 received in the draw bead groove 38. The blank 11 is drawn through the gap between the draw bead 36 and draw bead groove 38 by the central punch 26. The upper plate 24 supports the central punch 26 that is retracted by the cylinders 27 after the central area 30 of the blank 11 is held against the lower die 18. The cylinders 27 may be hydraulic cylinders, pneumatic cylinders or nitrogen cylinders that are actuated in conjunction with the draw press that moves the upper plate 24.

Figure 6:
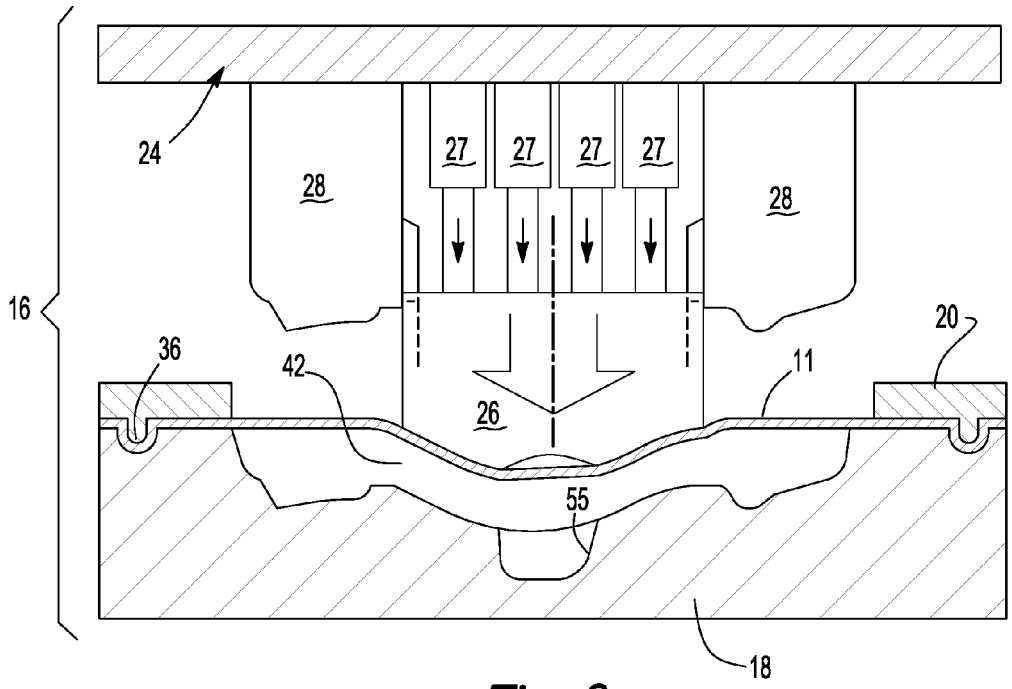
Figure 7:
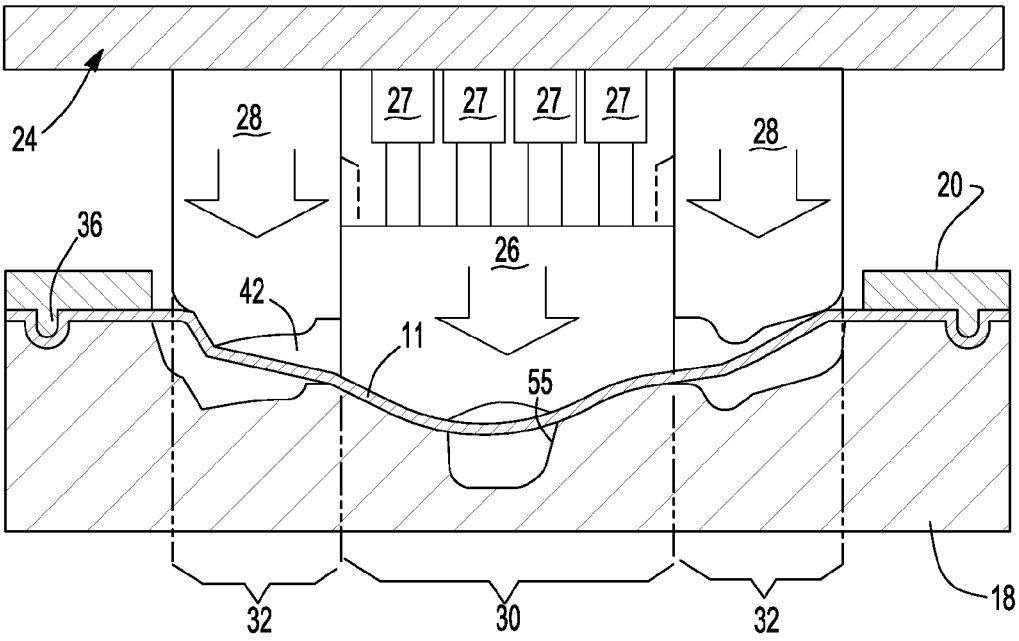
Figure 8:
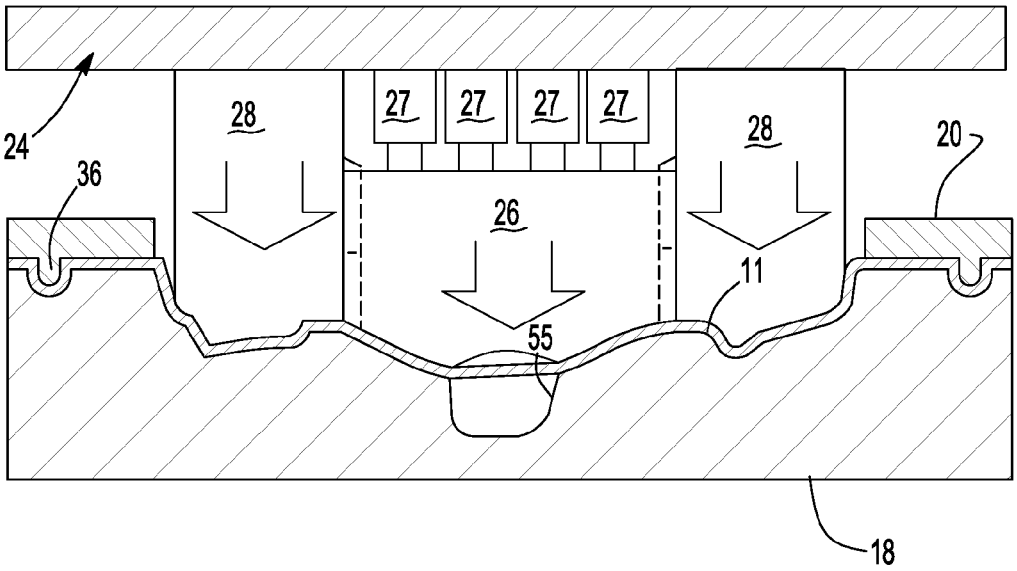

Referring to FIGS. 1, 6 and 7, the next step in the process corresponding to step 48 in FIG. 1 is to draw the central area 30 of the blank with the central punch 26. With continued reference to FIG. 6, the upper plate 24 is shown advancing the central punch 26 to draw the central area 30 of the blank 11. The large arrow on the central punch 26 illustrates the direction that the upper plate 24 moves the central punch 26. As the central punch 26 draws the blank 11 into the die cavity 42, the peripheral flange of the blank 11 is drawn into the cavity 42 from between the draw beads 36 and the draw bead grooves 38.

With reference to FIG. 7, the draw die set 16 is shown with the blank 11 clamped against the lower die 18. The side punches 28 supported by the upper plate 24 at this point begin to engage the blank 11 while the central punch 26 of the upper plate 24 clamps the blank 11 against the lower die 18. At this point, while the upper plate moves down, the cylinders 27 are compressed and hold the central punch 26 in the lowest position for the central punch 26. The side areas 32 are shown just prior to drawing the side areas 32 into the die cavity 42 formed in the lower die 18.

Referring to FIGS. 7 and 8, central punch 26 and side punches 28 of the upper plate 24 are shown after completing step 50 in FIG. 1. The side areas 32 of the blank 11 are drawn by the side punches 28 into engagement with the lower die 18. After completing forming the gaining pockets, the upper plate 24 returns to its original position moving the side punches 28 and the central punch 26 in the upper position. The cylinders 27 decompress and advance the central punch 26 to its original advanced position relative to the plate 24 and the side punches 26 while the upper plate retracts to the raised position.

Figure 9:
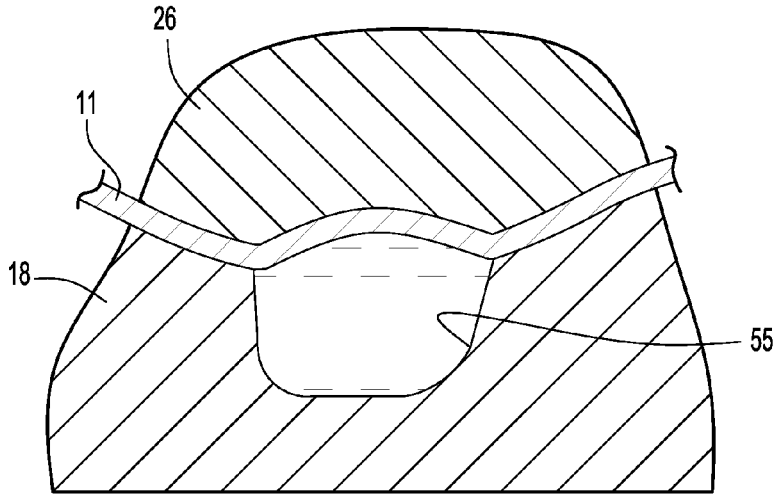
FIG. 9 is a fragmentary cross-sectional view of a hydroforming tool incorporated in the lower die and central punch illustrating the forming of a pocket of material for subsequent forming of corners and fine detail areas as shown in FIGS. 10 and 11.

As shown in FIG. 9, local areas of the blank 11 may be formed or hydro-formed into either the side areas 32 or central area 30 of the blank 11 to form gaining pockets at 52 in FIG. 1 that consist of material drawn into pockets that will be later formed into finely detailed areas of the blank 1 or areas that are formed into sharp corners.

Referring to FIG. 1, the drawn blank is unloaded from a draw die at 53 and is loaded at 54 into a second forming tool that may be a hydro-forming die, or an electro-hydraulic forming tool. In step 54, the drawn blank 11 is loaded into a second forming tool that may be a hydro-forming or electro-hydraulic forming tool.

Figure 10:
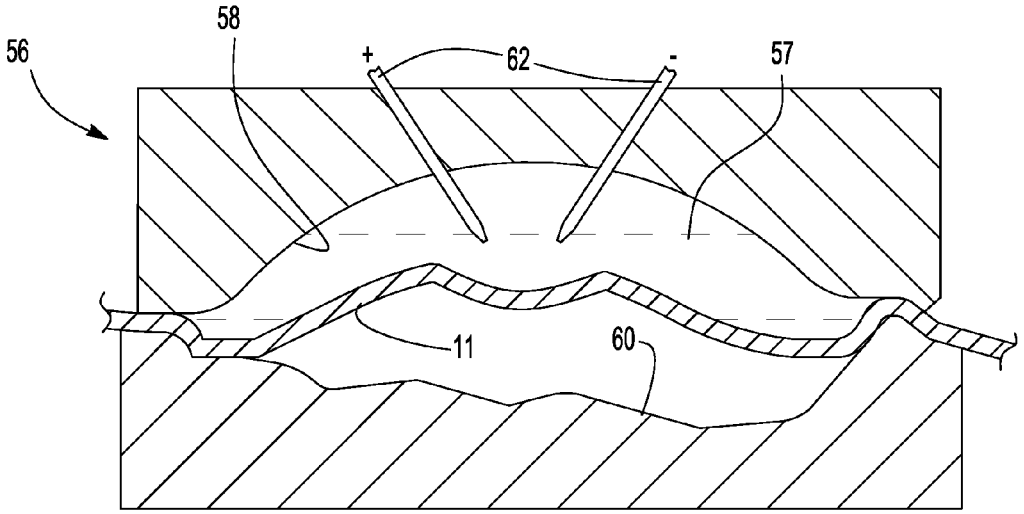
FIG. 10 is a fragmentary view of an electro-hydraulic forming tool showing a panel that was previously formed in the die set shown in FIGS. 2 and 5-8 ready to be formed in the tool.

Referring to FIG. 10, the drawn blank 11 is shown in an electro-hydraulic forming tool 56. The electro-hydraulic forming tool 56 is shown with the blank 11 and fluid 57 in a chamber 58 on one side of the blank 11. A forming recess 60 is formed in the forming tool 56. Electrodes 62 extend into the chamber 58 and are energized when a stored power source is discharged to create an electrical discharge in the fluid 57 that is used to form the blank 11 into the forming recess 60.

Figure 11:
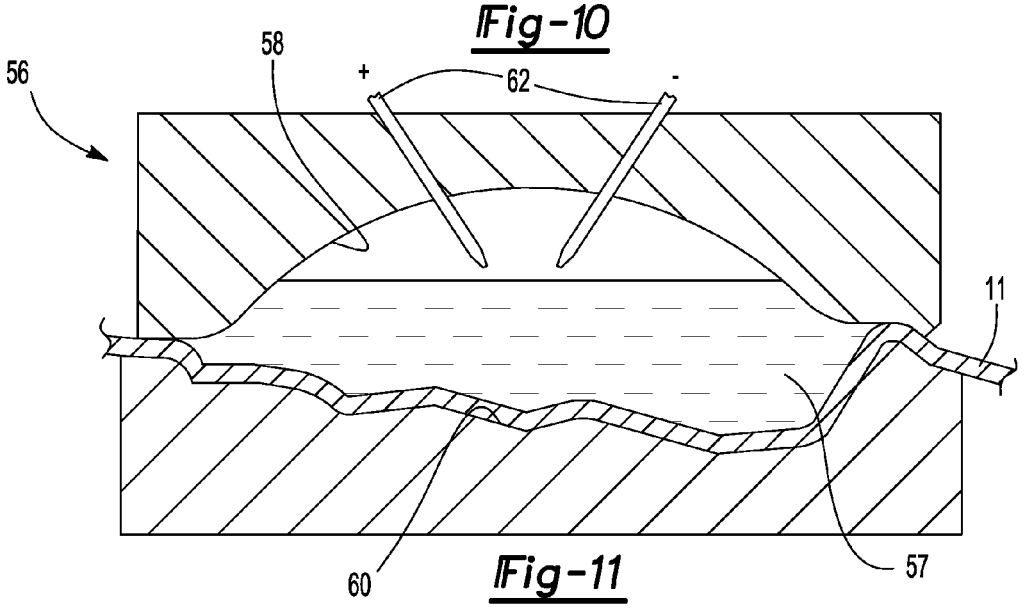
FIG. 11 is a fragmentary cross-section view showing the part in the electro-hydraulic forming tool shown in FIG. 9 after forming a pocket of the panel into a forming recess.

Referring to FIGS. 1 and 11, in the final step 64 of the process, the blank 11 is hydro-formed or electro-hydraulically formed into the recess 60. The gaining pockets previously formed at 44 may facilitate forming the blank 11 into corner areas or to form sharp edges or deep recesses.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method comprising:
clamping a blank in a binder of a draw die set;
drawing a first area of the blank with a first portion of a draw punch to form a pocket;
clamping the first area with the first portion; and
drawing a second area of the blank with a second portion of the draw punch while the first portion of the draw punch clamps the first area of the blank and drawing the pocket from the first area toward the second area.

2. The method of claim 1 wherein the binder includes a plurality of draw beads formed on the binder ring, the die defining a plurality draw bead grooves that each receive one of the draw beads, and wherein two draw beads and two draw bead grooves are provided in a selected area of the binder ring to provide increased resistance in the selected area during the step of drawing the first area of the blank with the first portion of the draw punch.

3. The method of claim 2 wherein the selected area of the binder ring further comprises a plurality of corner areas of the binder ring.

4. A method comprising:
clamping a blank in a binder of a die set;
drawing a first area of the blank with a first portion of a draw punch;
clamping the first area with the first portion;
drawing a second area of the blank with a second portion of the draw punch while the first portion of the draw punch clamps the first area of the blank; and
hydro-forming a predetermined area of the blank.

5. A method comprising:
clamping a blank in a binder of a draw die set;
drawing a first area of the blank with a first portion of a draw punch;
clamping the first area with the first portion; and
drawing a second area of the blank with a second portion of the draw punch while the first portion of the draw punch clamps the first area of the blank; and
hydro-forming a pocket in the first area of the blank to gain the material that is further spread into at least one sharp corner and at least one deep cavity.

6. A method of manufacturing a drawn panel comprising:
clamping a blank in a binder of a draw die set having a draw punch and a die that defines a cavity;
drawing a central area of the blank with a central draw punch into the cavity;
clamping the central area with the central draw punch against the die;
drawing at least one side area of the blank into the cavity with a side draw punch while the central draw punch clamps the central area of the blank; and
forming a pocket in the central area that is drawn from the central area towards the side area during the step of drawing the side area of the blank.

7. The method of claim 6 wherein the binder of the draw die set includes a plurality of draw beads formed on the binder ring, the die defining a plurality draw bead grooves that each receive one of the draw beads, and wherein two draw beads and two draw bead grooves are provided in a selected area of the binder ring to provide increased resistance in the selected area during the step of drawing the central area of the blank with the central draw punch.

8. The method of claim 7 wherein the selected area of the binder ring further comprises a plurality of corner areas of the binder ring.

9. A method of manufacturing a drawn panel comprising:
clamping a blank in a binder of a draw die set having a draw punch and a die that defines a cavity;
drawing a central area of the blank with a central draw punch into the cavity;
clamping the central area with the central draw punch against the die;
drawing at least one side area of the blank into the cavity with a side draw punch while the central draw punch clamps the central area of the blank; and
hydro-forming a predetermined area of the blank.

10. A method of manufacturing a drawn panel comprising:
clamping a blank in a binder of a draw die set having a draw punch and a die that defines a cavity;
drawing a central area of the blank with a central draw punch into the cavity;
clamping the central area with the central draw punch against the die;
drawing at least one side area of the blank into the cavity with a side draw punch while the central draw punch clamps the central area of the blank;
forming a pocket in the central area; and
hydro-forming the pocket in the central area of the blank to gain material that is further spread into at least one sharp corner and at least one deep cavity.

11. A draw die set and hydro-forming tool for drawing a blank comprising:

a die defining a die cavity within a peripheral clamping surface;

a binder ring selectively clamping the blank against the peripheral clamping surface; and a punch disposed within the binder ring, the punch having an advance contact portion and at least one delayed contact portion, wherein the advance contact portion engages the blank and draws a first area of the blank into the die cavity and clamps the first area against the die; and wherein the delayed contact portion engages the blank to draw a second area of the blank while the first area is clamped against the die, wherein the blank is loaded into the hydro-forming tool to form the blank into a forming recess.

12. The draw die and hydro-forming tool of claim 11 wherein the clamping surface defines a plurality of grooves, wherein the binder ring includes a plurality of draw beads that are received in the plurality of grooves, and wherein two rows of grooves and draw beads are provided where corners are formed in the blank.

* * * * *